US011794368B1

(12) United States Patent
Zelaya

(10) Patent No.: US 11,794,368 B1
(45) Date of Patent: Oct. 24, 2023

(54) THROWING KNIFE WITH DETACHABLE GUARD

(71) Applicant: Mario Zelaya, Burlington (CA)

(72) Inventor: Mario Zelaya, Burlington (CA)

( * ) Notice: Subject to any disclaimer, the term of this patent is extended or adjusted under 35 U.S.C. 154(b) by 756 days.

(21) Appl. No.: 16/942,246

(22) Filed: Jul. 29, 2020

(51) Int. Cl.
*B26B 29/02* (2006.01)
*F41B 15/00* (2006.01)
*B26B 3/00* (2006.01)

(52) U.S. Cl.
CPC ..... *B26B 29/02* (2013.01); *B26B 3/00* (2013.01); *F41B 15/00* (2013.01)

(58) Field of Classification Search
CPC ..... B26B 29/02
USPC ..... 30/295
See application file for complete search history.

(56) References Cited

U.S. PATENT DOCUMENTS 840,832 A * 1/1907 Everett
1,784,334 A * 12/1930 Callum ..... B26B 29/02 30/295
2,352,013 A * 6/1944 Roth ..... B26B 29/02 30/340
3,108,375 A * 10/1963 Papp ..... B26B 3/02 30/295
3,481,038 A * 12/1969 Cooper ..... B25G 3/02 228/187
D351,210 S * 10/1994 Koskinen ..... D22/118
D494,245 S * 8/2004 Rae ..... D22/118
7,921,567 B2 * 4/2011 Trbovich, Jr. ..... F41C 27/18 42/86

* cited by examiner

*Primary Examiner* — Hwei-Siu C Payer
(74) *Attorney, Agent, or Firm* — Sandy Lipkin

(57) ABSTRACT

A knife adapted for competitive knife-throwing that includes removable guards that can be added in the case that the knife throwing is directed toward a target with holes therethrough. The removable guards can be put in place prior to throwing at such a target to provide a stop against the hazard of the knife potentially moving through a hole and hitting an unintended target.

4 Claims, 5 Drawing Sheets

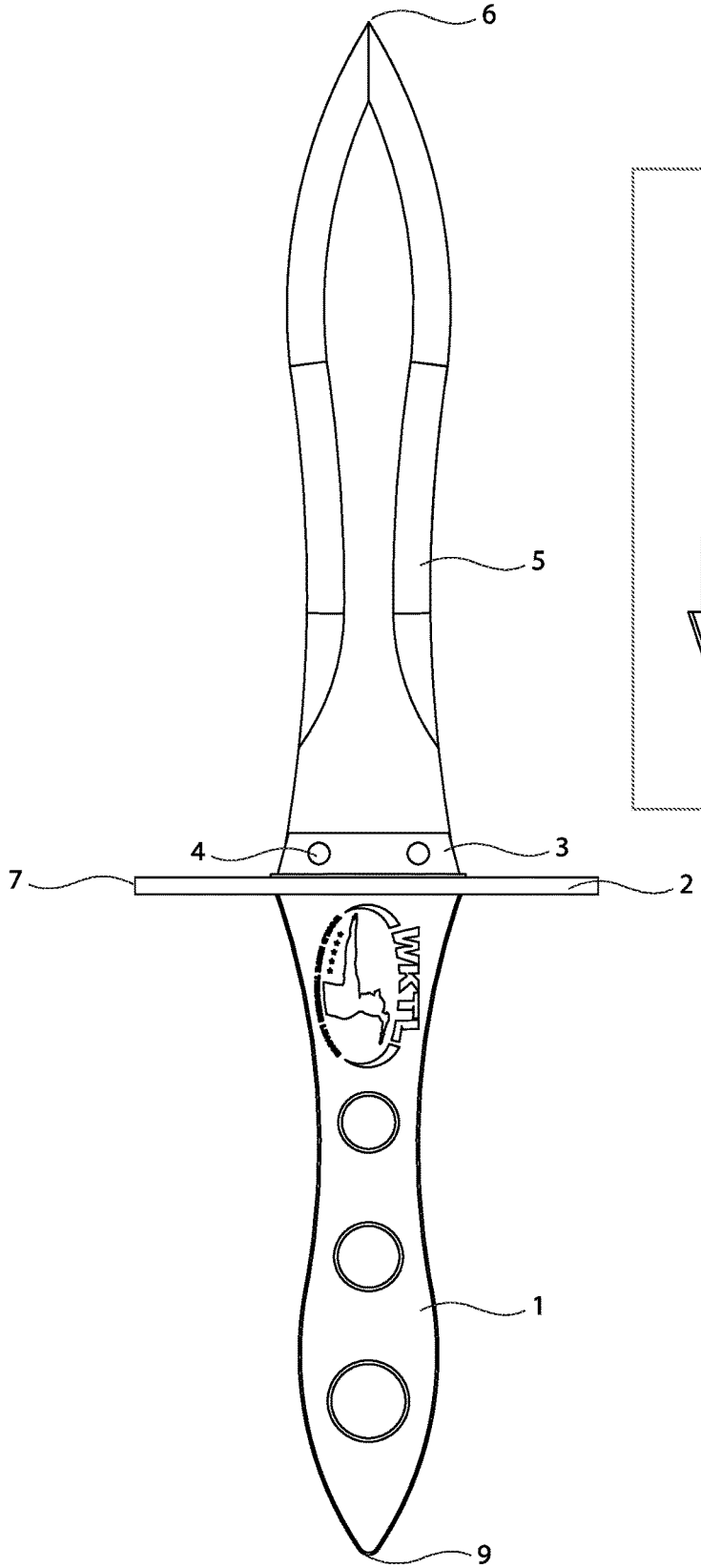
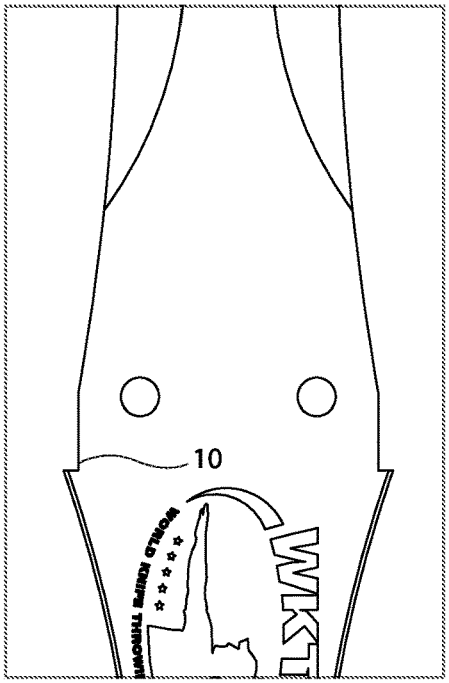
FIG 1A
Fig. 1

THROWING KNIFE WITH DETACHABLE GUARD

BACKGROUND OF THE INVENTION

Field of the Invention

The field of this invention relates generally to the field of throwing knives and more particularly toward a throwing knife that has increased safety for the sport with removable guards.

Description of the Prior Art

Traditionally, a knife is a tool that has been used for millennia to cut through matter, usually food such as meat and plants. Knives have likewise been used to cut through non-food items when a sharp edge is needed to cut through a substance. Knives can have a dull edge, such as a butter knife, but most knives hard a sharpened edge. This sharpened edge allows for ease in cutting through matter and as such can be very dangerous for human flesh should it be used, either intentionally or unintentionally through human flesh.

Knives have also been adopted for the activity of knife throwing. The objective in knife throwing is for the point of the knife to stick into the target with a sufficient amount of force. For this to be successful, accuracy, distance, number of rotations and placement of the body all must be taken into account.

Existing knives used for knife throwing are streamlined for throwing in order to allow for spin and control of the knife as it is thrown. Often times a knife is thrown at a target where targets are separated by barriers that can have holes therethrough, such as in the case of a chain link fence or other caging structures. A safety hazard exists in these instances in that the narrow profile of the knife has the potential to fly through the holes and to unintended targets beyond thereof, potentially causing harm to persons and/or property.

It is the object of the instant invention to provide for a throwing knife that includes replaceable guards that can be selectively used to provide a stop against a target where there are barriers that has holes therethrough.

SUMMARY OF THE INVENTION

The basic embodiment of the present invention teaches a knife for knife-throwing exercise comprising: a first end comprising a handle; a second end comprising a blade wherein said first and second end form one continuous piece having a slim profile; notches on a midpoint of said knife between said first end and said second end; a guard that is substantially planar with an aperture therethrough such that said guard can slide over said blade as said blade travels through said aperture and wherein said guard then can travel down a length of said blade until it reaches said notches and rests thereupon; a first guard fastener on top of said guard on one side of said knife; a second guard fastener on top of said guard on the other side of said knife wherein said first and said guard fasteners affix said guard to said knife and secure said guard thereto.

The above embodiment can be further modified by defining that said guard fasteners are secured with screws through apertures in said guard fasteners.

An alternate embodiment of the instant inventions teaches a method of providing a safety guard on a knife for knife-throwing comprising the steps of: acquiring a knife for throwing said knife further comprising: a first end comprising a handle; a second end comprising a blade wherein said first and second end form one continuous piece having a slim profile; notches on a midpoint of said knife between said first end and said second end; a guard that is substantially planar with an aperture therethrough such that said guard can slide over said blade as said blade travels through said aperture and wherein said guard then can travel down a length of said blade until it reaches said notches and rests thereupon; a first guard fastener on top of said guard on one side of said knife; a second guard fastener on top of said guard on the other side of said knife wherein said first and said guard fasteners affix said guard to said knife and secure said guard thereto; sliding said guard over said blade of said knife until it sets into said notches; placing said first guard fastener above said guard; placing said second guard faster above said guard on the opposing side of said knife from said first guard fastener; securing said first and second guard fasteners to said knife.

The above embodiment can be further modified by defining that there is the further step of securing said guard fasteners with screws through apertures in said guard fasteners.

BRIEF DESCRIPTION OF THE DRAWINGS

For a better understanding of the present invention, reference is to be made to the accompanying drawings. It is to be understood that the present invention is not limited to the precise arrangement shown in the drawings.

FIG. 1 is a front view of the throwing knife of the instant invention with the blade side pointing up.

FIG. 1A is a close up view of the mid-point of the knife of the instant invention as shown in FIG. 1 without the guard attached.

DETAILED DESCRIPTION OF A PREFERRED EMBODIMENT

Figure 2:
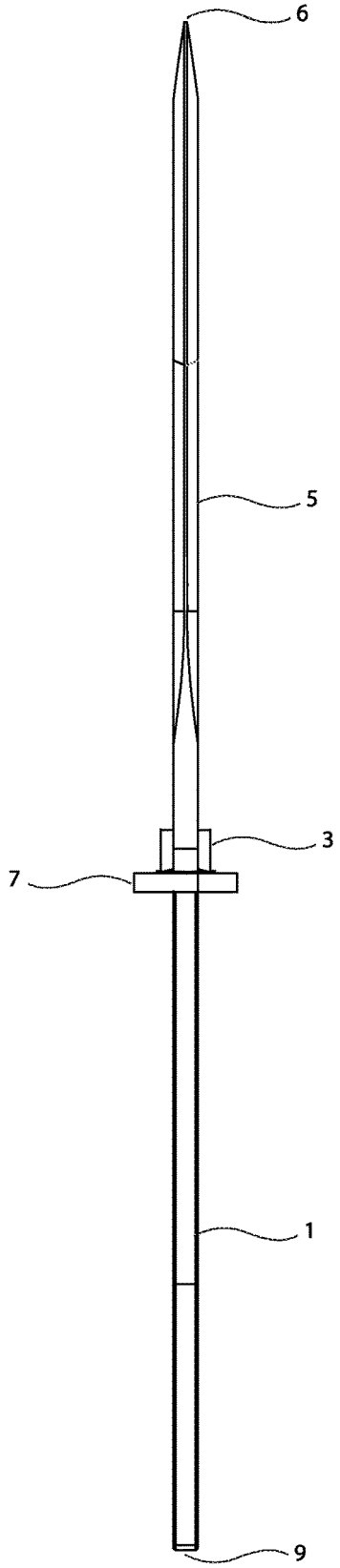
FIG. 2 is a side view of the throwing knife of the instant invention.
Figure 3:
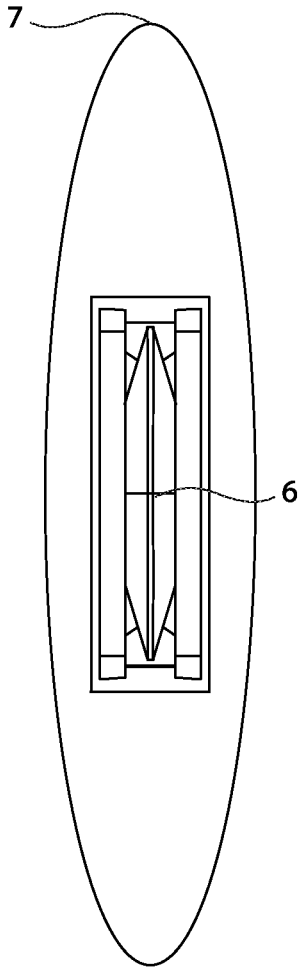
FIG. 3 is a top view of the throwing knife of the instant invention.
Figure 4:
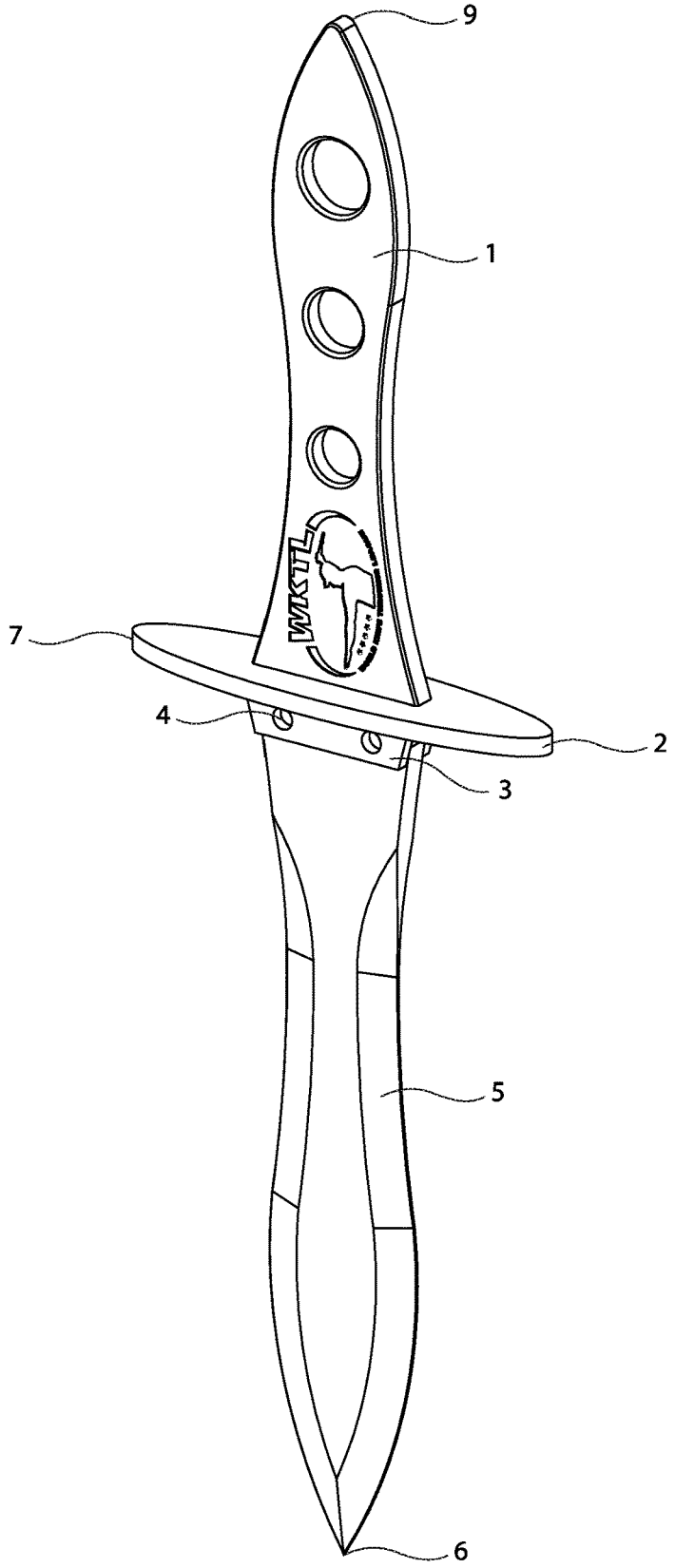
FIG. 4 is an isometric view of the throwing knife of the instant invention with the blade side pointing down.
Figure 5:
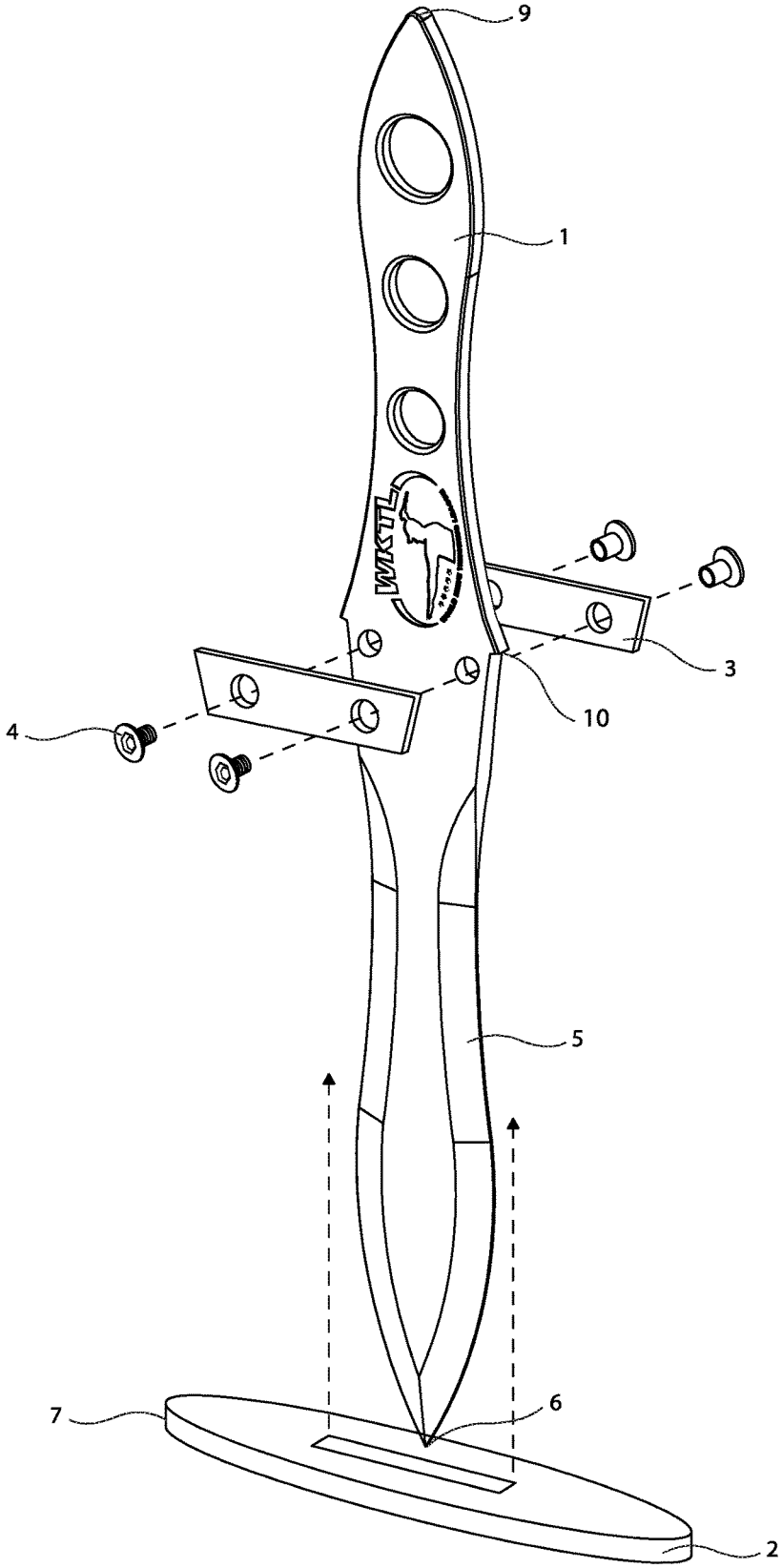
FIG. 5 is an exploded view of the throwing knife of the instant invention.

Turning to the drawings, the preferred embodiment is illustrated and described by reference characters that denote similar elements throughout the several views of the instant invention.

The preferred embodiment of the instant invention provides for a knife adapted for the sport of knife-throwing that includes the ability to attach guards to the knife in the event of throwing at a target where there are barriers that have holes therethrough such as a chain link fence or other caging type structures. Knife-throwing knives typically have a slim profile and due to spin when thrown have the potential to pass through a hole in a target thereby placing persons and property that may be beside the target in danger.

The knife of the instant invention has a handle 1 that is proximate a blade 5 and is one continuous piece. Without the guard 2, the knife extends from the handle 1 to the blade 5 with notches 10 on either side. As with a typical knife-throwing knife the blade 5 terminates in a sharp tip 6 that is the point that sticks the target when thrown. The profile thickness 9 of the handle 1 can be seen in FIG. 2. As is shown the profile is very thin on the side.

To utilize the method of the instant invention wherein the knife has a guard 2 to prevent the passing through of a hole in a target of the slim knife, a guard 2 is that is generally planar with a certain thickness 7 and a hole therethrough can be sheathed over the blade side of the knife and moved therealong until the guard 2 reaches the notches 10 and seats thereon. A pair of guard fasteners 3 are then attachable on either side of the knife along the profile of the knife such that the guard fasteners 3 are flush with the blade side of the knife in slim profile.

The guard fasteners 3 have one or more holes through which screws 4 can be fastened with flathead, Philips or Allen key type tools depending on the screws used to secure the guard 2 to the knife. The guard fastener is attached through the top blade side of the knife because to attach from the handle side would potentially place the guard in a vulnerable position where it could be knocked off of the knife if a second knife were to strike the knife from this direction in a subsequent throw.

To use the knife without the guard is to simply throw it without attaching the guard. To utilize the guard, the user merely slides the guard over the bladed as noted above and secures it thereto with the guard fasteners, screws and a screwdriver.

The invention illustratively disclosed herein suitably may be practiced in the absence of any element which is not specifically disclosed herein.

The discussion included in this detailed description is intended to serve as a basic description, The reader should be aware that the specific discussion may riot, explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A knife for knife-throwing exercise comprising:

a first end comprising a handle;

a second end comprising a blade wherein said first end and said second end form one continuous piece having a slim profile;

notches on a midpoint of said knife between said first end and said second end;

a guard that is substantially planar with an aperture therethrough such that said guard can slide over said blade as said blade travels through said aperture and wherein said guard then can travel down a length of said blade until it reaches said notches and rests thereupon;

a first guard fastener on top of said guard on one side of said knife;

a second guard fastener on top of said guard on the other side of said knife wherein said first and said guard fasteners affix said guard to said knife and secure said guard thereto.

2. The knife as defined in claim 1 wherein said guard fasteners are secured with screws through apertures in said guard fasteners.

3. A method of providing a safety guard on a knife for knife-throwing comprising the steps of:

acquiring a knife for throwing said knife further comprising:

a first end comprising a handle;

a second end comprising a blade wherein said first end and said second end form one continuous piece having a slim profile;

notches on a midpoint of said knife between said first end and said second end;

a guard that is substantially planar with an aperture therethrough such that said guard can slide over said blade as said blade travels through said aperture and wherein said guard then can travel down a length of said blade until it reaches said notches and rests thereupon;

a first guard fastener on top of said guard on one side of said knife;

a second guard fastener on top of said guard on the other side of said knife wherein said first arid said guard fasteners affix said guard to said knife and secure said guard thereto;

sliding said guard over said blade of said knife until it sets into said notches;

placing said first guard fastener above said guard;

placing said second guard faster above said guard on the opposing side of said knife from said first guard fastener;

securing said first and second guard fasteners to said knife.

4. The method as defined in claim 3 further comprising the step of securing said guard fasteners with screws through apertures in said guard fasteners.

* * * * *